US005885093A

United States Patent [19]

Champion et al.

[11] Patent Number: 5,885,093

[45] Date of Patent: Mar. 23, 1999

[54] CONNECTOR ASSEMBLY WITH INTERSPACED SIGNAL AND GROUND CONTACTS

[75] Inventors: Patrick Champion, Change, France; Danny Morlion, Amands Berg; Werner Panis, Tessenderlo, both of Belgium; Jacky Thenaisie, Le Mans, France; Jan Peter Karel Van Koetsem, Zwijndrecht; Luc Jonckheere, Dilbeek, both of Belgium

[73] Assignee: Framatome Connectors International, Courbevoie, France

[21] Appl. No.: 903,140

[22] Filed: Jul. 30, 1997

[30] Foreign Application Priority Data

Aug. 2, 1996 [FR] France ..... 96/09819

[51] Int. Cl.[6] ..... H01R 4/66

[52] U.S. Cl. ..... 439/101

[58] Field of Search ..... 439/108, 101, 439/608, 513, 517

[56] References Cited

U.S. PATENT DOCUMENTS

| | | | |
|---|---|---|---|
| 4,898,546 | 2/1990 | Elco et al. | 439/608 |
| 5,116,230 | 5/1992 | Dechelette et al. | 439/101 |
| 5,161,987 | 11/1992 | Sinisi | 439/108 |
| 5,174,764 | 12/1992 | Kandybowski et al. | 439/83 |
| 5,259,776 | 11/1993 | Giroux | 439/513 |
| 5,266,043 | 11/1993 | Giroux et al. | 439/513 |
| 5,277,606 | 1/1994 | Giroux et al. | 439/513 |
| 5,470,243 | 11/1995 | Bendorf | 439/513 |

FOREIGN PATENT DOCUMENTS

| | | |
|---|---|---|
| 0446980 A1 | 9/1991 | European Pat. Off. . |
| 0676833 A2 | 10/1995 | European Pat. Off. . |

*Primary Examiner*—Gary Paumen
*Assistant Examiner*—Antoine Ngandjui
*Attorney, Agent, or Firm*—Perman & Green, LLP

[57] ABSTRACT

A connector assembly comprises a first connector (1) and a second connector (2) adapted to be mated with the first connector. The first connector (1) comprises a first housing (3) having a bottom (4) and two longitudinal walls (5, 6) determining a receiving space (8), a row of male signal contacts (9) projecting from the bottom upwardly into the receiving space and a row of male ground contacts (10), wherein as seen in row direction a male ground contact is located at both sides of a corresponding male signal contact. The second connector (2) comprises a second housing (11) which can be substantially completely received within the receiving space, and a row of female signal contacts (12) adapted to be connected with the male signal contacts when the connectors are mated. Each female signal contact is at least partially enclosed by a corresponding female ground contact (13) having two contact parts (14) adapted to be connected with the male ground contacts at both sides of the corresponding male signal contact when the connectors are mated. The female ground contact extends along substantially the full height of the second housing.

9 Claims, 2 Drawing Sheets

CONNECTOR ASSEMBLY WITH INTERSPACED SIGNAL AND GROUND CONTACTS

BACKGROUND OF THE INVENTION

The present invention generally relates to a connector assembly, in particular a board-to-board connector assembly.

The invention aims to provide a connector assembly for application in systems with high signal speeds.

SUMMARY OF THE INVENTION

According to the invention a connector assembly is provided, comprising a first connector and a second connector adapted to be mated with said first connector, said first connector comprising a first housing having a bottom and two longitudinal walls determining a receiving space, a row of male signal contacts projecting from said bottom upwardly into said receiving space and a row of male ground contacts, wherein as seen in row direction a male ground contact is located at both sides of a corresponding male signal contact, said second connector comprising a second housing which can be substantially completely received within the receiving space, and a row of female signal contacts adapted to be connected with said male signal contacts when the connectors are mated, wherein each female signal contact is at least partially enclosed by a corresponding female ground contact having two contact parts adapted to be connected with the male ground contacts at both sides of the corresponding male signal contact when the connectors are mated, said female ground contact extending along substantially the full height of the second housing.

Preferably, a row of male ground contacts is located along at least one of said longitudinal walls and wherein said male signal and ground contacts each have a connection terminal at the outer side of said one longitudinal wall for surface mount connection to a contact area of a printed circuit board.

BRIEF DESCRIPTION OF THE DRAWINGS

The invention will be further explained by reference to the drawings in which an embodiment of the connector assembly according to the invention is shown.

DETAILED DESCRIPTION OF THE PREFERRED EMBODIMENTS

Figure 1:
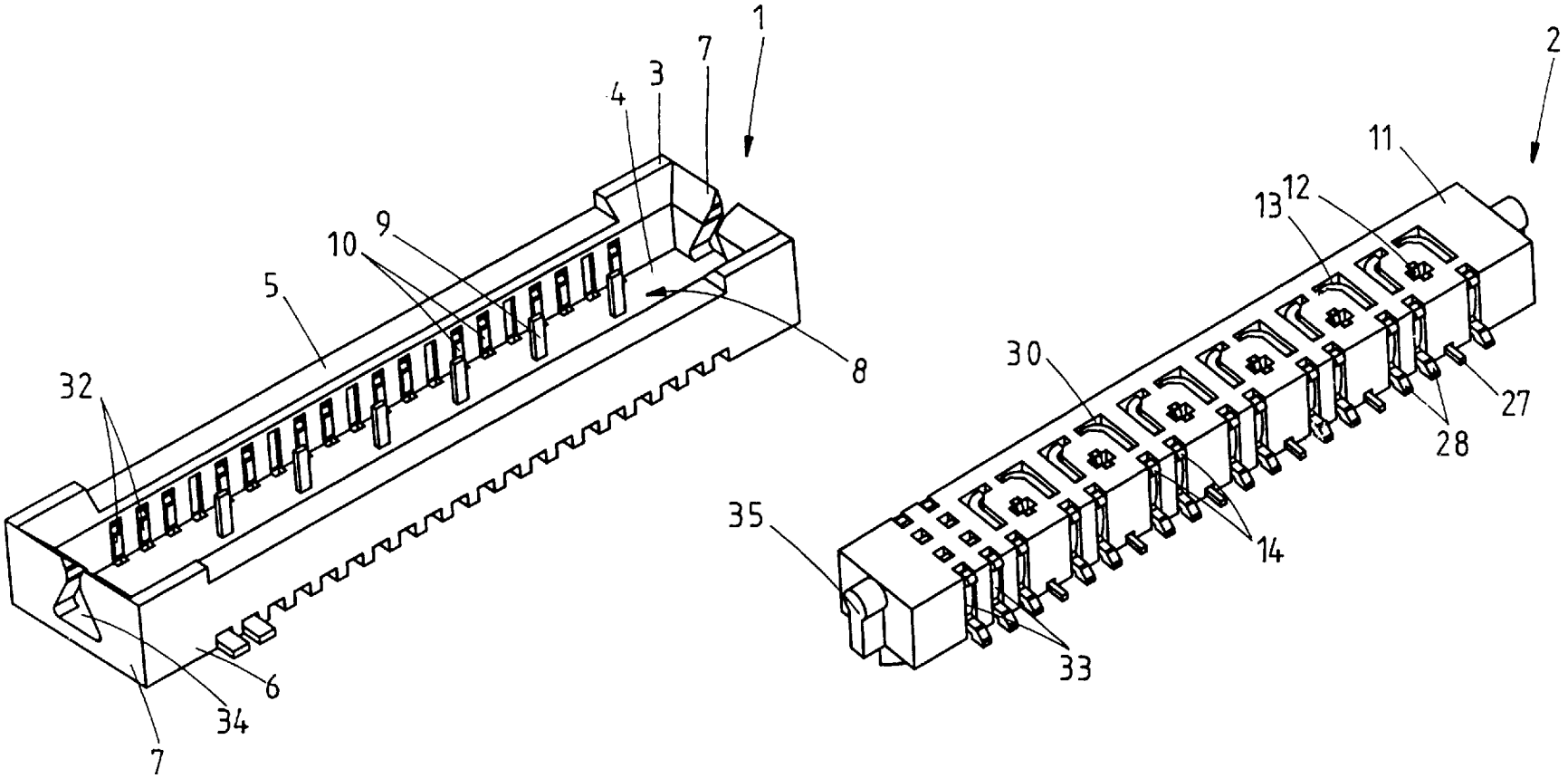
FIG. 1 shows a perspective view of an embodiment of the connector assembly according to the invention, wherein the first and second connectors are shown separately.

FIG. 1 shows a connector assembly comprising a first connector 1 and a second connector 2 adapted to be mated with the first connector. The first connector 1 comprises a first housing 3 having a bottom 4 and two longitudinal walls 5, 6 and two lateral walls 7 determining a receiving space 8.

A row of male signal contacts 9 is provided, the signal contacts 9 projecting from the bottom 4 upwardly into the receiving space 8. Further, a row of male ground contacts 10 is provided along the longitudinal wall 5. As seen in row direction, a male ground contact 10 is located at both sides of a corresponding male signal contact 9.

The second connector 2 comprises a second housing 11 which can be substantially completely received within the receiving space 8. The housing 11 is provided with a row of female signal contacts 12 adapted to be connected with the male signal contacts 9 when the connectors 1, 2 are mated. Each female signal contact 12 is at least partially enclosed by a corresponding female ground contact 13 having two contact parts 14 projecting from a longitudinal side of the housing 2 and adapted to be connected with the male ground contacts 10 at both sides of the corresponding male signal contact 9 when the connectors 1, 2 are mated. The female ground contact 13 extends along substantially the full height of the second housing 11.

Figure 2:
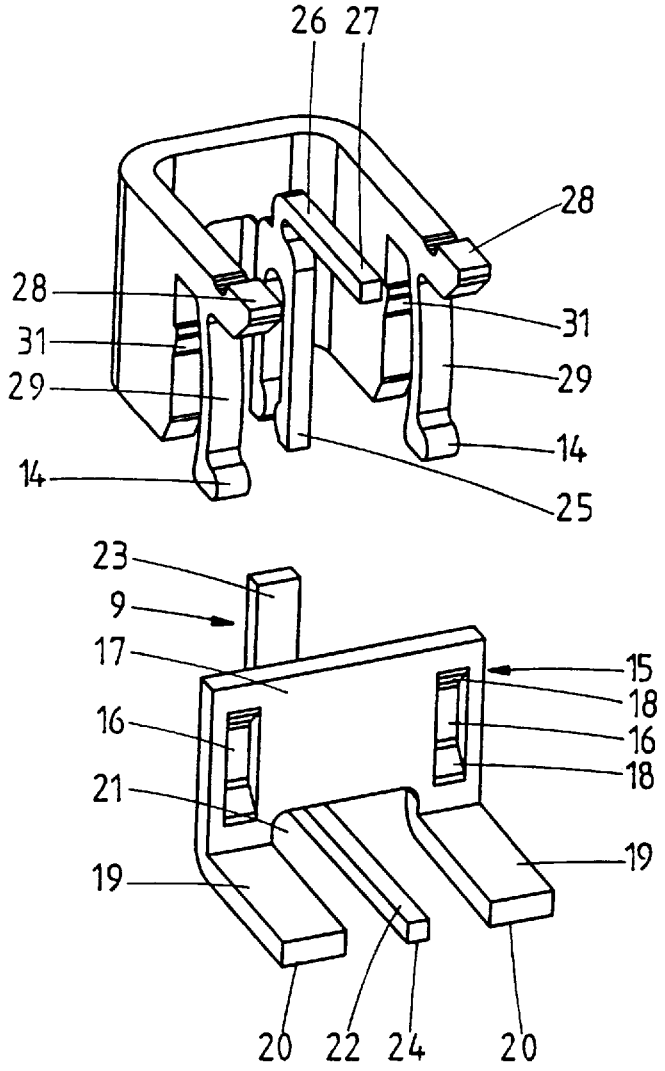
FIG. 2 is a perspective view of the male and female signal and ground contacts.

The male and female signal and ground contacts 9, 10, 12 and 13 are shown in detail in FIG. 2. The male ground contacts 10 lying at both sides of a corresponding male signal contact 9 are made integral as one common male ground contact element 15 having two contact sections 16 formed out of a first leg 17 and joining said first leg 17 through oblique sections 18. The contact sections 16 are adapted to contact the contact parts 14 of a corresponding female ground contact 13. The common male ground contact element 15 further comprises second and third legs 19 each providing a connection terminal 20 for surface mount connection to a contact area of a printed circuit board not shown. The width of the legs 19 is less than half the width of the leg 17 and the leg 17 has a passage 21 for a leg 22 of the corresponding male signal contact 9 comprising a further leg 23 projecting into the receiving space 8. The leg 22 of the male signal contact 9 provides a connection terminal 24 for surface mount connection to a contact area of a printed circuit board. All connection terminals 20 and 24 of the male signal and ground contacts 9, 10 are provided along the longitudinal wall 5 at a given pitch.

The same applies to the female signal and ground contacts 12, 13. Each female signal contact 12 comprises a contact fork 25 having two contact portions adapted to contact the leg 23 of a male signal contact 9. Further, the female signal contact 12 comprises a leg 26 providing a connection terminal 27 for surface mount connection to a contact area of a printed circuit board not shown. The connection terminal 27 is located in the center between two connection terminals 28 of the corresponding female ground contact 13. As shown in FIG. 1, all connection terminals 27, 28 are located along a longitudinal side of the second housing 11 at said given pitch.

The female ground contact 13 has a mainly U-shaped top view wherein the connection terminals 28 are provided at the free ends of the U-shaped ground contact 13. Further, a contact spring 29 is provided at each free end of the female ground contact 13, said contact spring 29 carrying one of the two contact parts 14 of a ground contact 13.

From FIG. 2 it will be understood that in the mated position of the connectors 1, 2, the signal path through the signal contacts 9 and 12 is fully enclosed by the male and female ground contacts 10 and 13.

The female ground contacts 13 are mounted in chambers 30 of the second housing 11, wherein at each of the free ends of the U-shaped female ground contact 13 a locking lug 31 is provided for mounting the ground contact in the chamber 30.

At one end of the connectors 1, 2 power contact elements 32, 33 are provided. These power contact elements 32, 33 are further disclosed in a patent application of the same date of the same applicant, which application is incorporated here by reference.

Further, the housing 3 is provided with centering recesses 34 while the housing 11 is provided with centering projections 35 providing an accurate alignment of the contacts and further providing an indication of the fully mated position as further disclosed in a patent application of the same date of the same applicant. For a further description reference is made to this patent application.

The invention is not restricted to the above-described embodiment which can be varied in a number of ways within the scope of the claims.

What is claimed is:

1. Connector assembly, comprising a first connector and a second connector adapted to be mated with said first connector, said first connector comprising a first housing having a bottom and two longitudinal walls determining a receiving space, a row of male signal contacts projecting from said bottom upwardly into said receiving space and a row of male ground contacts, wherein one of the male ground contacts is located at both sides of a corresponding one of the male signal contacts, said second connector comprising a second housing which can be substantially completely received within the receiving space, and a row of female signal contacts adapted to be connected with said male signal contacts when the connectors are mated, wherein each female signal contact is at least partially enclosed by a corresponding female ground contact having two contact parts adapted to be connected with the male ground contact at both sides of the corresponding male signal contact when the connectors are mated, said female ground contact extending along substantially the full height of the second housing.

2. Connector assembly according to claim 1, wherein a row of male ground contacts is located along at least one of said longitudinal walls and wherein said male signal and ground contacts each have a connection terminal at the outer side of said one longitudinal wall for surface mount connection to a contact area of a printed circuit board.

3. Connector assembly according to claim 1, wherein the male ground contact lying at both sides of a male signal contact are made integral as one common male ground contact element having two contact sections.

4. Connector assembly according to claim 3, wherein each male ground contact element comprises a first leg with said two contact sections adapted to contact the contact parts of a female ground contact, and second and third legs each providing a connection terminal, wherein the corresponding male signal contact comprises a first leg projecting upwardly into said receiving space and a second leg providing a connection terminal located between the connection terminals of the common male ground contact, wherein a passage is provided in the first leg of the common males ground contact for said second leg of the male signal contact.

5. Connector assembly according to claim 1, wherein said female signal and ground contacts have connection terminals along one longitudinal side of the housing for surface mount connection to contact areas of a printed circuit board, wherein a female ground contact is provided with two connection terminals one at each side of the connection terminal of the corresponding female signal contacts.

6. Connector assembly according to claim 5, wherein each female ground contact has a mainly U-shaped top view, wherein a connection terminal and a contact spring with one of said two contact parts are provided at each of the free ends of the U-shaped ground contact.

7. Connector assembly according to claim 6, wherein each female ground contact is provided with a locking lug at each of the free ends of the U-shape for mounting the ground contact in a chamber of the second housing.

8. Connector assembly according to claim 1, comprising a housing having a bottom and two longitudinal walls determining a receiving space, a row of male signal contacts projecting from said bottom upwardly into said receiving space and a row of male ground contacts, wherein each of the male ground contact is located at both sides of a corresponding male signal contact, wherein said row of one of the male ground contacts is located along at least one of said longitudinal walls and wherein said male signal and ground contacts each have a connection terminal at the outer side of said one longitudinal wall for surface mount connection to a contact area of a printed circuit board.

9. Connector assembly according to claim 1, comprising a housing and a row of female signal contacts, each female signal contact being at least partially enclosed by a corresponding female ground contact having two contact parts, and extending along substantially the full height of the housing, wherein said female signal and ground contacts have connection terminals along one longitudinal side of the housing for surface mount connection to contact areas of a printed circuit board, wherein each female ground contact is provided with two connection terminals one at each side of the connection terminal of the corresponding female signal contact.

* * * * *